US007959474B2

(12) United States Patent
Beyer et al.

(10) Patent No.: US 7,959,474 B2
(45) Date of Patent: Jun. 14, 2011

(54) ELECTRICAL ADDITIONAL MODULE FOR A SERVICE DEVICE, COMBINATION OF THE ADDITIONAL MODULE WITH THE SERVICE DEVICE, AS WELL AS AN ADDITIONAL MODULE SET

(75) Inventors: Stefan Beyer, Ebermannsdorf (DE); Wolfgang Schatz, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 159 days.

(21) Appl. No.: 12/310,682

(22) PCT Filed: Sep. 8, 2006

(86) PCT No.: PCT/DE2006/001573

§ 371 (c)(1),
(2), (4) Date: Mar. 4, 2009

(87) PCT Pub. No.: WO2008/028433

PCT Pub. Date: Mar. 13, 2008

(65) Prior Publication Data

US 2010/0240237 A1 Sep. 23, 2010

(51) Int. Cl.
*H01R 9/22* (2006.01)

(52) U.S. Cl. ..... 439/712

(58) Field of Classification Search ..... 439/709, 439/712, 713

See application file for complete search history.

(56) References Cited

U.S. PATENT DOCUMENTS

| | | | | |
|---|---|---|---|---|
| 4,913,663 | A * | 4/1990 | Siemon et al. | 439/509 |
| 5,629,831 | A | 5/1997 | Eggert et al. | |
| 5,652,420 | A * | 7/1997 | Innes et al. | 200/50.32 |
| 6,663,441 | B1 * | 12/2003 | Alexandre et al. | 439/715 |
| 6,733,347 | B2 * | 5/2004 | Palet Mercader et al. | 439/810 |
| 6,783,403 | B2 * | 8/2004 | Lafragette et al. | 439/717 |

(Continued)

FOREIGN PATENT DOCUMENTS

| | | | |
|---|---|---|---|
| DE | 4438806 | C1 | 3/1996 |
| DE | 10227422 | A1 | 1/2004 |
| DE | 10301003 | B3 | 9/2004 |
| DE | 10301004 | B3 | 10/2004 |
| EP | 1564848 | A1 | 8/2005 |

*Primary Examiner* — T C Patel
*Assistant Examiner* — Harshad C Patel
(74) *Attorney, Agent, or Firm* — Harness, Dickey & Pierce, P.L.C.

(57) ABSTRACT

Service devices are used in the field of automation and normally form interfaces between programmable logic controllers (PLC) and the installations or installation components to be controlled. Service devices such as these generally have a multiplicity of electrical interfaces for additional modules, with the additional modules being connected via control lines to the PLC, to further service devices or to installation components. An electrical additional module for a service device, a combination of the additional module with the service device, and an additional module set having various additional modules which allow easier fitting and removal of the additional modules in the service device are disclosed. In at least one embodiment, an electrical additional module is proposed, having an appliance interface for fitting the additional module to a service device, with the service device having a stepped holding geometry with at least two steps on each of which a contact device is arranged for holding an electrical opposing contact device, with the appliance interface having step sections which are designed to be complementary to the at least two steps and on which in each case one of the electrical opposing contact device is arranged in order to make contact with the associated contact device, and with the at least two step sections being rigidly connected to one another when the additional module is not fitted.

16 Claims, 5 Drawing Sheets

U.S. PATENT DOCUMENTS 6,851,985 B2 * 2/2005 Lafragette et al. ..... 439/701
7,173,809 B2 * 2/2007 Bauer et al. ..... 361/611
7,713,072 B2 * 5/2010 Azzola et al. ..... 439/119
2004/0043671 A1 3/2004 Brasse et al.
2006/0134956 A1 6/2006 Freimuth et al.
2006/0245169 A1 11/2006 Freimuth et al.

* cited by examiner

ELECTRICAL ADDITIONAL MODULE FOR A SERVICE DEVICE, COMBINATION OF THE ADDITIONAL MODULE WITH THE SERVICE DEVICE, AS WELL AS AN ADDITIONAL MODULE SET

PRIORITY STATEMENT

This application is the national phase under 35 U.S.C. §371 of PCT International Application No. PCT/DE2006/001573 which has an International filing date of Sep. 8, 2006, which designated the United States of America, the entire contents of which are hereby incorporated herein by reference.

FIELD

At least one embodiment of the invention generally relates to an electrical additional module with a device interface for fitting the additional module on a service device, to a combination of the additional module with the service device and/or to an additional module set with electrical additional modules.

BACKGROUND

Service devices are used in the field of automation and generally form interfaces between programmable logic controllers (PLCs) and the assemblies or assembly components to be controlled. Such service devices generally have a large number of electrical interfaces for additional modules, the additional modules being connected to the PLC, further service devices or assembly components via control lines.

The document EP 1 564 848 A1 has disclosed a service device with a plurality of interfaces, which are arranged on two opposite sides of the service device in graduated fashion in the manner of stairs, with each interface being mechanically coded in order to be able to fit an additional module associated with the interface in a manner which prevents confusion.

The documents DE 103 01 004 B3 and DE 103 01 003 B3, which each disclose the same service device as an exemplary embodiment, describe a service device which has module slots as interfaces, which module slots are likewise arranged in graduated fashion in the manner of stairs and into which slots in each case one associated additional module can be plugged. These module slots are also mechanically coded. Said documents form the closest prior art.

SUMMARY

At least one embodiment of the invention is based on the problem of proposing an electrical additional module for a service device, a combination of the additional module with the service device and an addition module set with various additional modules which permit simplified fitting and removal of the additional modules in the service device.

In at least one embodiment, this problem is solved by an additional module, by a combination and by an additional module. Example embodiments of the invention are disclosed in the description below and in the figures.

The electrical additional module according to at least one embodiment of the invention has a device interface, which is formed to make mechanical and electrical contact between the additional module and a service device. In order to mechanically accommodate the additional module, the service device has an accommodating geometry which is graduated in the manner of stairs and comprises at least two steps.

An electrical contact device, which is formed to accommodate and make contact with opposing contact device, is associated with each of the at least two steps. Thus, each of the at least two steps forms a module slot. The service device forms a multi-step contact zone, optionally with steps of different widths. Preferably, the service device is designed for connection to a PLC and in particular comprises passive or active electrical devices such as signal converters, filters, switching circuits or distribution circuits or the like.

The device interface of the additional module has at least two step sections which are formed so as to be complementary with respect to the at least two steps. In each case one opposing contact device for making contact with the associated contact device owing to the complementary formation is arranged on each of the at least two step sections, with the result that the additional module comprises a contact-making interface with two or more stories.

The contact device and opposing contact device preferably have contact elements, which are formed on the one hand as contact tongues, contact lugs or contact pins and on the other hand as fork-shaped contact elements. Preferably, contact device and opposing contact device each comprise a plurality of contact elements in order to enable a multi-pole connection at each connection point formed by contact device and the associated opposing contact device.

According to at least one embodiment of the invention, the at least two step sections of the additional module are already rigidly connected to one another in the unoccupied or unfitted state. The connection is in particular formed in such a way that the additional module can be inserted in one working step when it is fitted on the service device such that the at least two steps of the service device are equipped at the same time or together. In this way, for example, an additional module which is used for interfacing a bus, which requires contact to be made with contact device of different steps, can be fitted and contact-connected in one working step.

Various alternative embodiments of the additional module can differ from one another by the number of step sections and/or the number of poles of the opposing contact devices. Thus, it is possible for the additional module to also be fitted on three or more steps of a correspondingly formed service device at the same time or together.

In this case, at least one embodiment of the invention is based on the concept that joint contact being made with contact device of a plurality of steps by way of a single additional module results in an increase in simplicity in the design of the electrical control assemblies and in elimination of possible sources of faults. This is achieved by virtue of the fact that the additional module makes contact with the service device at the same time over a plurality of steps and can be fitted, removed, or retrofitted in one working step. In addition, the complexity involved with the wiring of the control assemblies is reduced. A reduction in the amount of warehousing space required can also be achieved since the number of variant embodiments of the additional modules is reduced.

In an embodiment which is particularly favorable in terms of manufacture, the at least two step sections are formed in one piece or as an integral composite and/or form a partial section of a common housing. The step sections, the partial section of the common housing or the housing are preferably produced in an injection-molding process.

Preferably, at least one of the step sections has a resting region and a bearing region. In this case, the resting region is preferably formed as a mechanical stop in order to define the end position when the additional module is slid onto the service device. The bearing region can optionally act as a mechanical guide for the additional module whilst the latter is slid onto the service device. A bearing face of the bearing region is preferably oriented perpendicular or substantially perpendicular to a resting face of the resting region.

In an advantageous development, the additional module has guide apparatuses, which form a module-side part of a sliding guide. The sliding guide is preferably formed as positive guidance in order to facilitate the fitting of the additional module. The sliding guide is implemented such that the additional module can be slid onto the service device along a sliding direction, which is aligned parallel or substantially parallel to the bearing face and/or perpendicular or substantially perpendicular to the resting face. The additional module is slid on from an intermediate position into the end position, in which the additional module and the service device are in contact with one another.

In example developments, the additional module is designed for fitting and removal without the use of tools. In order to mechanically secure the functional module in the end position or installed position, optional locking device(s) are provided, which are formed as, for example, latching device(s), in particular with latching hooks. Alternatively, the locking device(s) are realized for fitting without the use of tools and for removal with the necessary use of a tool.

In a possible development, the guide apparatuses are formed as part of a module-side plug-in guide, with the result that the additional module can be brought into the intermediate position in guided fashion during fitting. The plug-in movement takes place in the direction of a plug-in direction, which is oriented perpendicular or substantially perpendicular to the sliding direction. The plug-in guide is optionally also formed as positive guidance. The fitting of the functional module therefore takes place by a combined plug-in and sliding movement. This design embodiment of the functional module has the advantage that the fitting of the additional module is also possible without any problems if a plurality of service devices are arranged next to one another in a row, since no space at the side, i.e. in the direction of the adjacent service devices, is required for fitting purposes.

Preferably, the guide apparatus has mechanical coding device(s) in order to ensure fitting which prevents confusion. The guide apparatus therefore assumes a dual function, namely a guide function and a coding function.

In an example design embodiment of the additional module, the guide apparatuses are formed as laterally integrally formed or attached cheeks with guide paths in particular for accommodating hook elements or other elements. In an example configuration, the guide paths of cheeks of a step section are arranged opposite one another pointing inwards or are formed into the cheeks.

Preferably, the cheeks are mechanically coded by the width, the height and/or the profile of the guide paths, in particular the cheeks of a step section and/or the cheeks of two different step sections being mechanically coded differently.

In order to improve the mechanical compatibility between the additional module and the service device, the resting regions and/or the bearing regions have cutouts for inserting or guiding through device-side contact elements of the electrical contact means. The cutouts of the resting region and the bearing region are in particular connected to one another in open fashion, with the result that the cutouts are formed as open edge sections. Preferably, a contact element is associated with each edge section.

In an advantageous development, the contact elements of the opposing contact device(s) are arranged within the housing and/or integrated in the step sections. In this way, in particular the risk of accidental touching contact being made with the contact elements during fitting is minimized. For the same purpose, optionally the contact elements of the contact means are likewise provided with mechanical electric shock prevention device(s).

In a further advantageous development of at least one embodiment of the invention, the functional module has in each case one printed circuit board plane for each of the at least two step sections, which printed circuit board planes preferably each support the contact elements of the opposing contact means of the associated step section. Each printed circuit board plane can be formed equivalently by one of a plurality of separate printed circuit boards or a portion of a flexible printed circuit board folded into a plurality of planes. In particular, the contact elements are soldered on the printed circuit board. Preferably, the printed circuit boards or printed circuit board pieces are arranged parallel to one another and/or parallel or substantially parallel to the bearing region. The correct positioning of the printed circuit boards in the housing of the additional module is preferably ensured by guide ribs integrally formed on the inner sides of the housing. This design furthermore allows a space-saving arrangement within the housing and efficient manufacture.

In addition it is preferably provided that the opposing contact device(s) are connected to one another in particular via the printed circuit boards or printed circuit board pieces within the housing or the additional module. In this case, direct contact is preferably provided, with the result that signals of one step of the service device can be looped through to another step of the service device.

Alternatively or in addition, a processing device is provided, with the result that signals of one step of the service device can be processed within the housing or the functional module and can be output to the same or another step of the functional module. In this way, signals from a plurality of steps of the service device can be passed on and/or processed within the functional module.

Preferably, further application devices are provided within the functional module which are likewise connected to one or more of the printed circuit boards and/or the processing device and which are preferably formed as temperature sensors, voltage measurement device, voltage monitoring device(s) etc. Thereby or using other processing devices, the functional module becomes an active subassembly, which can implement functions autonomously.

In order to further prevent confusion during fitting, mechanical individual coding device(s) are optionally formed which in one design development are formed as in particular integrally formed, projecting key elements and/or as receptacles in the form of lock elements. The individual coding means are preferably implemented in such a way that even the plug-in movement during fitting is prevented in the case of a confusion.

At least one embodiment of the invention also relates to a combination of the functional module and the service device, as have both already been described, and the service device being designed so as to be mechanically and electrically compatible with the electrical additional module. In particular, the service module has the device-side parts of the guide apparatus.

The service device is preferably formed as a timing relay, a function relay or a switching element. The contact means preferably form electrical interfaces for interfacing supplies (for example for feeding operational voltages), data lines (for example buses or signaling contacts), signal transmitters (for example sensors, switches, pushbuttons) or a PLC.

Preferably, the accommodating geometry of the service device is formed such that connection terminals, as are known from the prior art, still remain compatible and can still be used.

A further subject matter of an embodiment of the invention relates to an additional module set, which comprises a large number of the electrical additional modules, the additional modules being coded in a functionally dependent and module-specific manner. The additional modules therefore differ from one another in particular in terms of the functionality and of the mechanical coding and are otherwise identical in terms of construction.

BRIEF DESCRIPTION OF THE DRAWINGS

Further features, advantages and effects of the invention result from the description below and the attached drawings of a preferred example embodiment. In the drawings.

Identical or corresponding parts are provided in each case with the same reference symbols in the figures.

DETAILED DESCRIPTION OF THE EXAMPLE EMBODIMENTS

Figure 1:
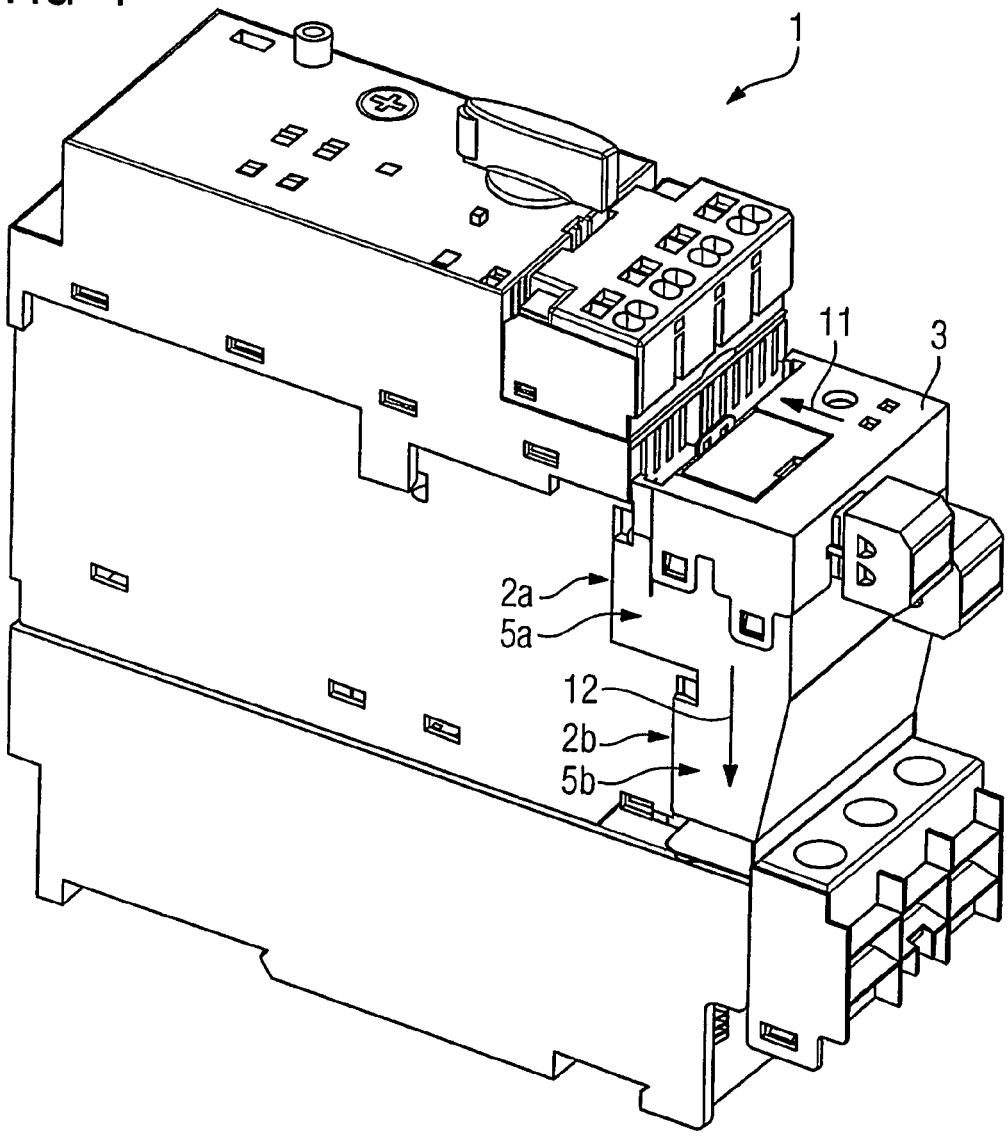
FIG. 1 shows a service device with an additional module positioned thereon as an example embodiment of the invention in a three-dimensional, schematic illustration.

FIG. 1 shows, in a schematic plan view at an angle from the side in a three-dimensional illustration, a service device 1 formed as an automatic switching device, the service device 1 having two steps 2*a,b* on its narrow side in addition to further electrical interfaces, with an additional module 3 being fitted on said steps.

As can be seen from the illustration in FIG. 1, the steps 2*a,b* in a plan view from the side are formed as rectangular regions, which run in the manner of stairs. In each case one contact device(s) (not illustrated) is associated with each of the steps 2*a,b*, with the result that each step 2*a,b* forms a module slot with an associated contact device(s), and the module slots being arranged with a vertical offset with respect to one another. By way of the additional module 3, in the fitted state contact is made between the two contact devices of the steps 2*a,b* and the respectively associated opposing contact means 4 (FIG. 6) of the additional module 3. Fastening device(s), for example for fastening on a top-hat rail in a switchgear cabinet, are formed on the underside of the service device 1.

At least sections of the additional module 3 are formed so as to be complementary with respect to the bearing geometry of the service device 1 formed by the two steps 2*a,b*. For this purpose, the additional module 3 has two step sections 5*a,b*, the step section 5*a* being associated with the step 2*a* and the step section 5*b* being associated with the step 2*b*. The step sections 5*a,b* also have in each case a geometry which is graduated in rectangular fashion in the contact region with the service device 1 or the steps 2*a,b* in a plan view from the side.

Figure 2:
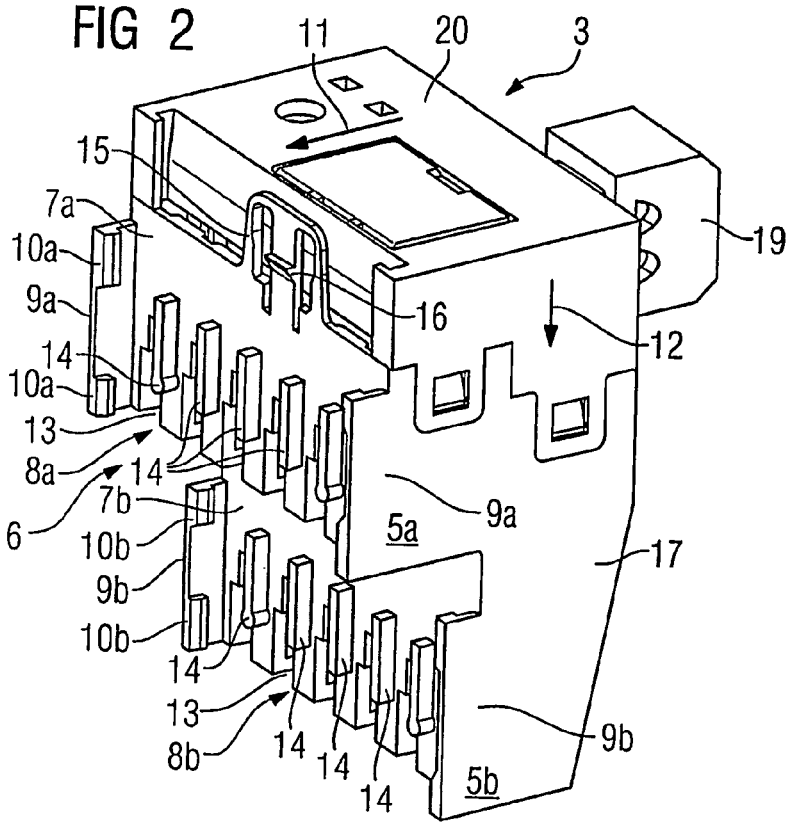
FIG. 2 shows the additional module in FIG. 1 in a three-dimensional, schematic illustration with a view of the device interface of the additional module.

FIG. 2 shows the additional module 3 in FIG. 1 in a schematic, three-dimensional view rotated so as to show details of a device interface 6, which is formed by the two step sections 5*a,b*. The device interface 6 is used for mechanically fastening the additional module 3 on the service device 1 and making electrical contact with said additional module 3 on said service device 1.

The step section 5*a* has a bearing region 7*a* and a resting region 8*a*, which is arranged approximately at right angles with respect thereto. The bearing region 7*a* is used for bearing against a region of the step 2*a* which is vertically aligned in FIG. 1, in particular in such a way that when the additional module 3 is slid onto the service device 1, the bearing region 7*a* is guided in sliding fashion on the region of the step 2*a*. On the other hand, the resting region 8*a* is formed as a mechanical stop, which abuts a region of the step 2*a* which is aligned horizontally in FIG. 1 as soon as the additional module 3 has been slid completely onto the service device 1.

The step section 5*a* is delimited on both sides laterally by two cheeks 9*a*, which are in the form of extensions of the side walls of the functional module 3 and are aligned in perpendicularly projecting fashion with respect to the bearing region 7*a*. The vertically illustrated height in FIG. 2 of the cheeks 9*a* substantially corresponds to the vertical extent of the bearing region 7*a*. The projecting cheeks 9*a* show, in a plan view from the side, a rectangular cross section. Protrusions 10*a* are arranged or integrally formed on the inner sides of the cheeks 9*a* which are aligned with one another, with the result that the cheeks 9*a* form mechanically coded guide apparatuses with open guide channels, which are used to mechanically guide hook elements (not illustrated) of the service device 1 and at the same time to check for the appropriate mechanical coding.

For the purposes of better understanding, the fitting of the additional module 3 on the service device 1 will be outlined briefly below. The fitting takes place via a combined plug-in and sliding movement, with the additional module 3 being plugged onto the service device 1 into an intermediate position in a first step. The plug-in movement takes place in the plug-in direction, which is visualized by a first arrow 11, which is aligned horizontally in FIG. 2 and in addition perpendicularly with respect to the bearing face 7*a*. In a second step, the additional module 3 is bought from the intermediate position into an end position, which corresponds to the contact-making position, in a sliding direction which is illustrated by a second arrow 12, which is aligned vertically in FIG. 2 and perpendicular to the plug-in direction arrow 11.

The cheeks 9*a* in FIG. 2 can only accommodate hook elements of the service device whose vertical extent is less than the height of the guide channel formed by the protrusions 10*a* of one of the cheeks 9*a* owing to the mechanical coding during the plug-in movement, as a result of which a first mechanical coding is provided.

The bearing region 7*a* and the resting region 8*a* form a common edge region, which is interrupted a number of times, in this example embodiment five times, by cutouts 13, the cutouts 13 being in the form of cut-out slit regions. The cutouts 13 are used for inserting contact elements of the device-side contact device during the plug-in movement and for accommodating these contact elements during the sliding movement.

Individual coding device 14 in the form of vertically running webs are integrally formed on the bearing region 7*a*, which individual coding device are accommodated as key elements during the plug-in and sliding movement by appropriately fitting lock elements in the form of accommodating openings in the service device 1.

A second mechanical coding is formed via the length and the width of, and the distance between, the webs of the additional module 3 or by the formation of the accommodating openings in the service device 1, which second mechanical coding only permits fitting which prevents confusion. The individual coding device 14 and the cutouts 13 are arranged alternately in the bearing region 7*a*.

The step section 5*b* has a similar configuration to the step section 5*a*, with the result that reference is made to the description of the step section 5*a* for the description of the step section 5*b*. The bearing region 7*b* is arranged so as to be offset parallel to the bearing region 7*a*, the offset being formed by a translation counter to the plug-in direction arrow 11 and in the sliding direction arrow 12. The resting region 8*b* is arranged with a similar offset with respect to the resting region 8*a*. In order to avoid overdefinition of the additional module 3 in the end position in the service device 1, it is preferably provided that either the resting region 8*a* or the resting region 8*b* acts as a mechanical stop. Alternatively, another mechanical stop can also be used.

Figure 7:
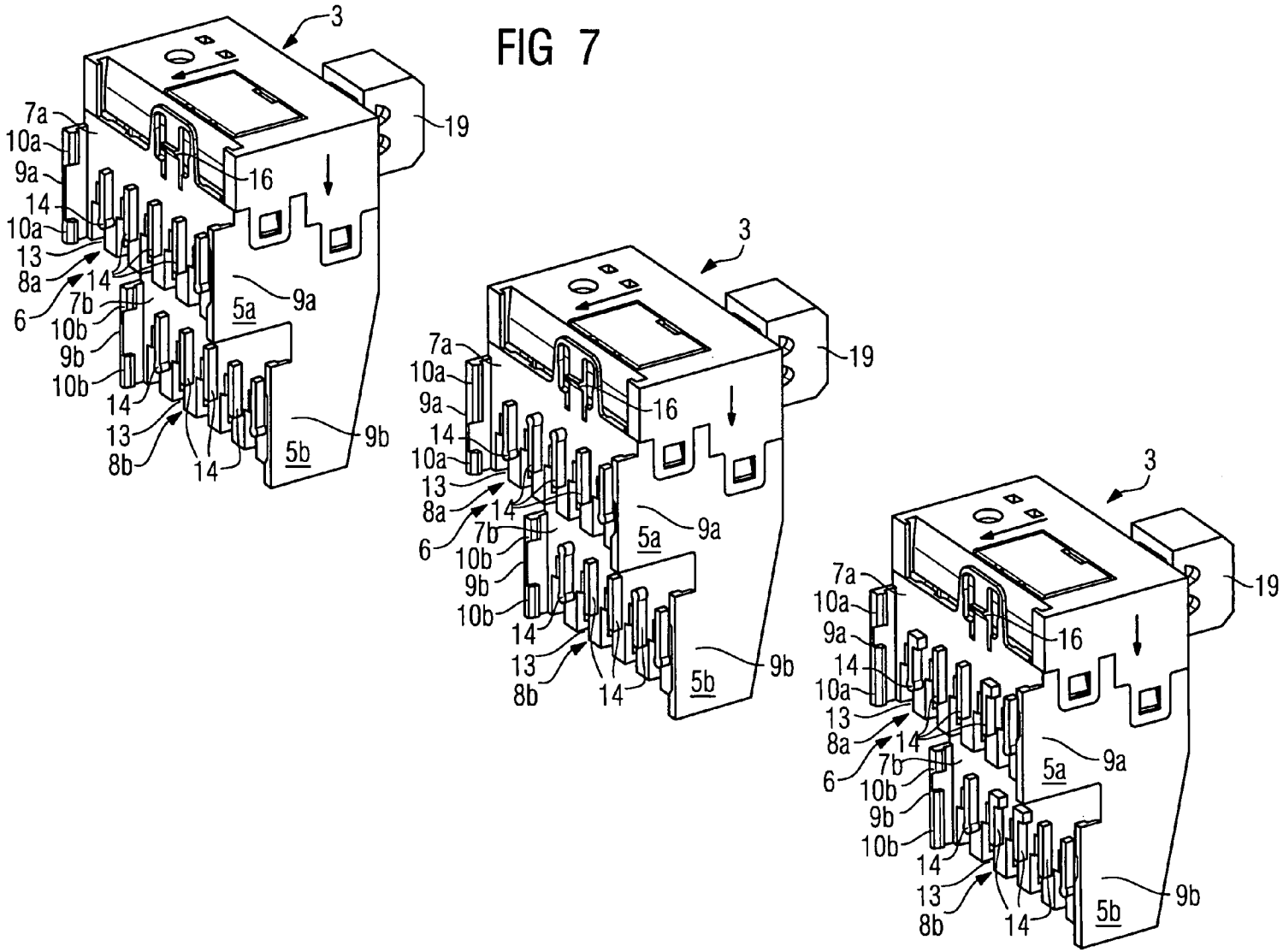
FIG. 7 shows a plurality of additional modules, the electrical additional modules each being coded differently in a module-specific manner.

The in total four cheeks 9*a,b* with corresponding protrusions 10*a*, 10*b* have either in each case the same guide channel, possibly with a mirror-symmetrical formation, or are mechanically coded differently (FIG. 7) depending on the associated step section 5*a,b*.

In order to lock the additional module 3 in the service device 1, an elastic tongue is integrally formed, as latching means 15, in the bearing region 7*a* so as to project centrally in the vertical direction counter to the sliding direction arrow 12. The elastic tongue supports a latching hook 16, which snaps into a corresponding latching opening in the service device 1 during fitting and locks the additional module 3 in the service device 1. In this case, the latching hook 16 is formed, in particular by corresponding bevels, in such a way that the locking takes place independently or automatically during fitting. For removal purposes, on the other hand, the elastic tongue needs to be bent counter to the plug-in direction arrow 11 in order to unlock the latching means 15. preferably, the latching means 15 are formed in design terms in such a way that a tool, for example a screw driver, necessarily needs to be used for unlocking purposes.

The step sections 5*a,b* are part of a common housing 17, which is formed integrally, and on which the above described structural elements are integrally formed or in which said elements are formed. The housing 17 is produced for example in a cost-effective manner in an injection-molding process.

Figure 3:
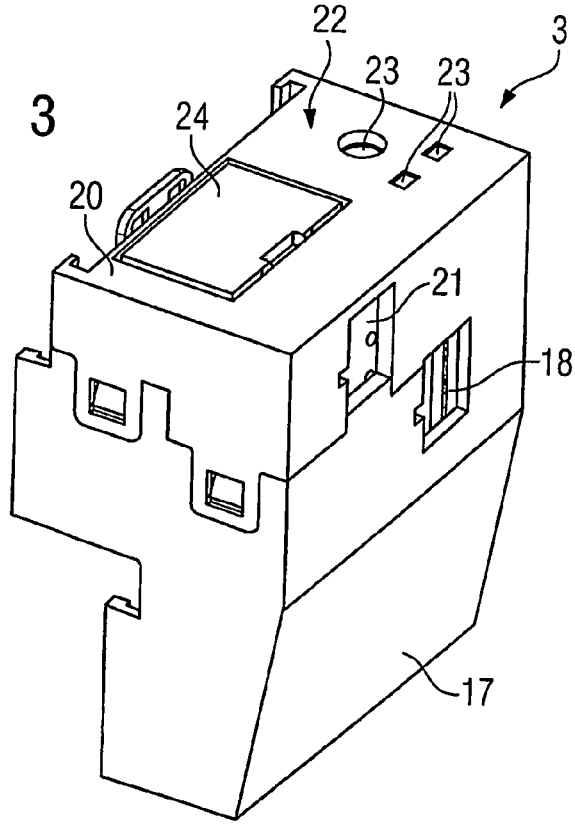
FIG. 3 shows the additional module in FIG. 1 in a three-dimensional, schematic illustration with a view of the rear side of the additional module.

As can best be seen in FIG. 3, which shows the additional module 3 in a schematic, three-dimensional illustration from the rear side opposite the device interface 6, the housing 17 has a socket opening 18, into which a plug 19 (FIG. 2) can be inserted in order to make contact. The plug 19 is used, for example, for making contact with a databus or for connection to further additional modules, service devices, sensors, switches or the like. The rear side of the additional module 3 is beveled in the lower section, inter alia in order to form a bevel for removal from the mold during manufacture of the housing 17.

A cover element 20, which is snapped onto the housing 17 and terminates said housing, is positioned on the upper (in FIGS. 2 and 3) section of the housing 17. Alternatively, the cover element 20 can also be plugged on or screwed on. The cover element 20 is integral and is preferably likewise produced by an injection-molding process. The cover element 20 has a further socket opening 21 on the rear side of the additional module 3, with the result that, depending on the inner configuration of the additional module 3, plugs 19 can be plugged into a socket opening 18 of the housing 17 or into a socket opening 21 of the cover element 20.

Further access openings 23 are introduced on the upper side 22 (illustrated in FIGS. 2 and 3) of the cover element 20. In particular, the cover element 20 on the upper side 22 has a cover 24 which can be broken open and which makes it possible for the user to retrospectively open up a further contact-making option, in particular a plug-type connection. This contact-making option can be used, for example, for emergency stop circuit wiring or standardized end position wiring, in particular in a development of the additional module 3 as a motor starter bus connection.

Figure 4:
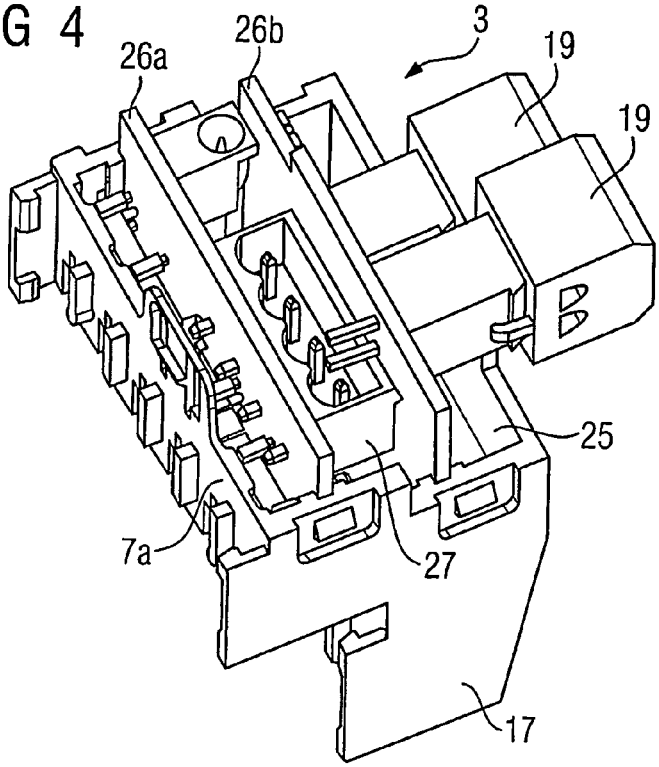
FIG. 4 shows the additional module in FIG. 1 in a three-dimensional, schematic illustration without the cover element.

FIG. 4 shows the additional module 3 in the open state, i.e. without the cover element 20, in a schematic, three-dimensional illustration at an angle from above. In contrast to the previous figures, two plugs 19 are plugged into the additional module 3. The housing 17 forms an interior 25, in which two printed circuit board planes with a first printed circuit board 26*a* and a second printed circuit board 26*b* are arranged parallel to one another and parallel to the bearing faces 7*a,b*.

In this case, the first printed circuit board 26*a* is associated with the step section 5*a* and supports the contact elements 4 (FIG. 6) of the opposing contact device of the step section 5*a*. The contact elements 4 of the first step section 5*a* are soldered on the first printed circuit board 26*a*. Similarly, the second printed circuit board 26*b* supports the contact elements 4 of the opposing contact means of the step section 5*b*. The first and second printed circuit boards 26*a* and *b* are optionally in electrical contact with one another, with the result that signal paths are formed between the opposing contact device of the step sections 5*a,b*. Electrical circuits are applied to both printed circuit boards 26*a* and *b*.

A socket 27, which can be reached when the cover element 20 is closed via the cover 24 which can be broken open, is arranged between the printed circuit boards 26*a,b*. Optionally, first and second printed circuit boards 26*a,b* are mechanically rigidly connected to one another, for example by virtue of the socket 27 being fastened as a mechanical connecting element on both printed circuit boards 26*a,b*.

Figure 5:
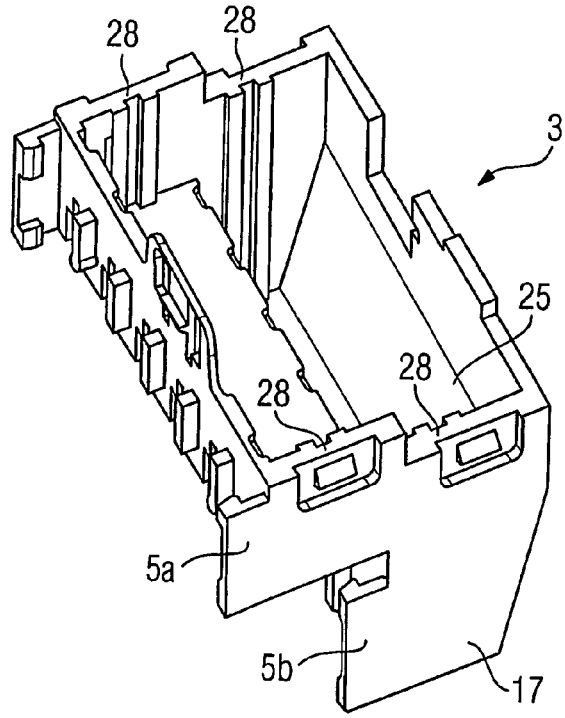
FIG. 5 shows the additional module in FIG. 1 in a three-dimensional, schematic illustration without the cover element and without any fittings.

FIG. 5 shows the housing 17 in the same illustration as in FIG. 4, with the printed circuit boards 26*a,b* which form an electrical functional group being removed. As can be seen from the view of the interior 25, guide rails 28 with U-shaped guide grooves are arranged on both sides and opposite one another and make it possible to precisely position the printed circuit boards 26*a,b* in the housing 17. As can likewise be seen in this illustration, the interior 25 is also formed in graduated fashion in the manner of stairs, with the result that the second printed circuit board 26*b* is not hidden with respect to the service device 1 in the region of the step section 5*b* via the first printed circuit board 26*a*.

Figure 6:
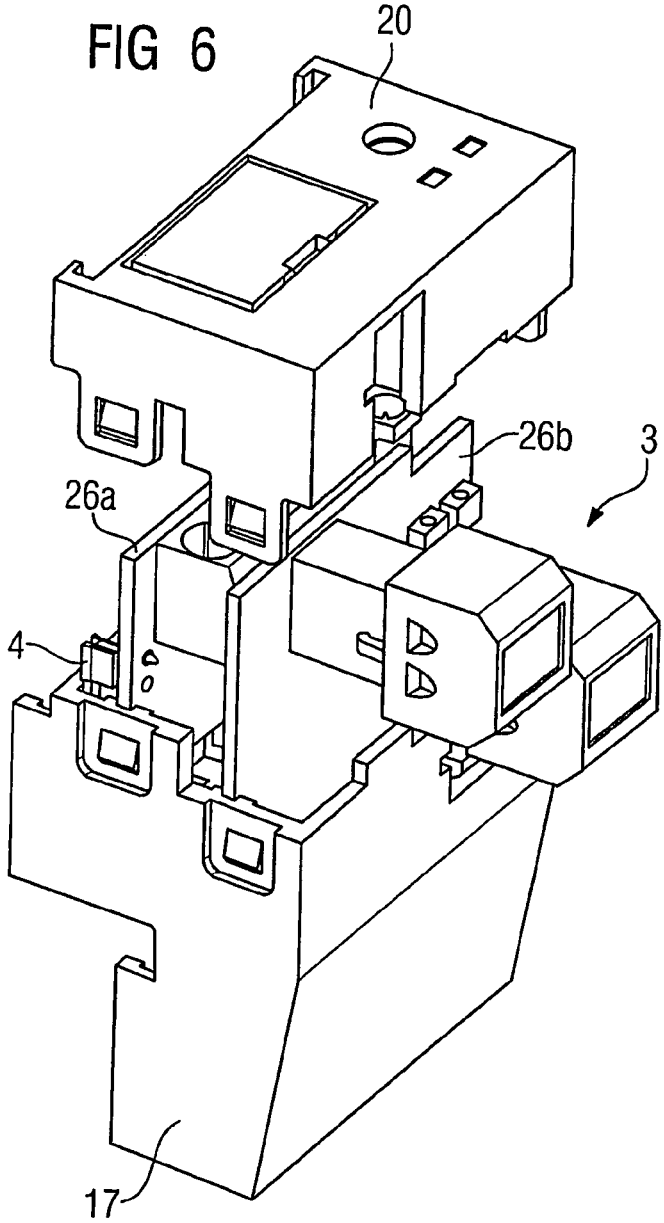
FIG. 6 shows the additional module in FIG. 1 in a three-dimensional, schematic exploded illustration.

FIG. 6 shows the additional module 3 in a schematic, three-dimensional illustration in an exploded view of the rear side. This illustration also shows a fork-like contact element 4, which is soldered on the first printed circuit board 26*a*. In the installed state, all of the contact elements 4 of the first and the second printed circuit boards 26*a,b* are accommodated in the interior 25, in particular in such a way that it is not possible for a user to come into touching contact with them. In the example illustrated, the printed circuit boards 26*a,b* are only connected via the socket 27; in alternative embodiments processing units or sensors can be integrated in the additional module 3 which are likewise in contact with the two printed circuit boards 26*a,b*, with the result that the additional module 3 is in the form of an active functional subassembly. Examples of an active functional subassembly which can be implemented are temperature measurement, voltage measurement or corresponding monitoring systems.

When assembling the additional module 3, the printed circuit boards 26*a,b* are inserted into the guide rails 128 and pushed into the interior 25. In the process it is possible for the housing 17 to be equipped with the two printed circuit boards 26*a,b* at the same time in a common working step, with the precise guidance and positioning taking place by means of the guide rails 28. By way of the guide rails 28 or another mechanical stop being delimited at the end side, the position of the printed circuit boards 26*a,b* in the housing 17 is defined. In a next step, the cover element 20 is snapped on, with the printed circuit boards 26*a,b* being fixed finally and precisely or with little tolerance in position by means of a mechanical bearing region in the cover element 20 for the printed circuit boards 26*a,b*. This structural formation of the additional module 3 allows cost-effective manufacture, with at the same time low tolerances, of a fully equipped attachment module, which can therefore also be fitted in a customer-friendly manner, with contact being made with said attachment module at the same time over a plurality of steps, and with the attachment module additionally being capable of being completely removed and retrofitted.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An electrical additional module, comprising:

a device interface for fitting the electrical additional module on a service device to which the additional module may be attached, the service device having a graduated accommodating geometry with at least two steps and an electrical contact device for accommodating an opposing electrical contact device on the additional module is arranged on each of the at least two steps of the service device, the device interface including step sections which are formed so as to be complementary with respect to the at least two steps of the service device and on which, in each case, one of the opposing electrical contact devices is arranged for making contact with the associated electrical contact device, wherein in an unoccupied state of the electrical additional module, the at least two step sections are rigidly connected to one another; and guide apparatuses forming a module-side part of a sliding guide for sliding the additional electrical module onto the service device from an intermediate position as far as an end position along a sliding direction, at least one of parallel to a bearing region and perpendicular to a resting region, the guide apparatuses including at least one of a mechanical coding device and laterally integrally formed or attached cheeks with guide paths for accommodating device-side hook elements, the cheeks of the step sections having differently coded mechanical coding devices.

2. The electrical additional module as claimed in claim 1, further comprising:

a cover element; and a housing including the step sections, the cover element being positioned onto the housing and terminating said housing, the cover element on an upper side having a cover, which is capable of being broken open and which makes it possible for a user to retrospectively open up a further contact-making option.

3. The electrical additional module as claimed in claim 2, wherein the electrical contact elements of the opposing contact devices are arranged within the housing.

4. The electrical additional module as claimed in claim 3, further comprising:

at least two printed circuit board planes, each formed by a printed circuit board or a portion of a correspondingly folded printed circuit board, one of the printed circuit board planes being associated with each of the at least two step sections, and the associated printed circuit board plane supporting the electrical contact elements of the opposing contact device of the step section.

5. The electrical additional module as claimed in claim 4, wherein at least one of the step sections has a resting region and a bearing region and wherein the printed circuit board planes are arranged parallel to one another and at least one of parallel to the bearing region and perpendicular to the resting region.

6. The electrical additional module as claimed in claim 2, wherein the opposing contact device of the step sections are connected to one another at least one of directly and via a processing device within at least one of the electrical additional module and the housing.

7. The electrical additional module as claimed in claim 2, wherein the at least two step sections are formed at least one of in one piece and as part of a common housing.

8. A combination, comprising:

the electrical additional module as claimed in claim 2; and the service device, the service device being designed so as to be mechanically and electrically compatible with the electrical additional module.

9. An additional module set, comprising:

a plurality of the electrical additional modules as claimed in claim 2, the electrical additional modules each being coded differently in a module-specific manner.

10. The electrical additional module as claimed in claim 1, wherein the at least two step sections are formed at least one of in one piece and as part of a common housing.

11. The electrical additional module as claimed in claim 1, wherein at least one of the step sections has a resting region and a bearing region.

12. The electrical additional module as claimed in claim 11, wherein the guide apparatuses form a module-side part of a plug-in guide for plugging the additional module onto the service device into the intermediate position along a plug-in direction at least one of perpendicular to the bearing region and parallel to the resting region.

13. The electrical additional module as claimed in claim 11, wherein at least one of the resting region and bearing region has cutouts for guiding through device-side contact elements of the electrical contact device.

14. The electrical additional module as claimed in claim 1, further comprising:

mechanical individual coding devices, formed between the cheeks as at least one of projecting key elements and cutouts in the form of lock elements.

15. A combination, comprising:

the electrical additional module as claimed in claim 1; and the service device, the service device being designed so as to be mechanically and electrically compatible with the electrical additional module.

16. An additional module set, comprising:

a plurality of the electrical additional modules as claimed in claim 1, the electrical additional modules each being coded differently in a module-specific manner.

* * * * *